US008801338B2

(12) United States Patent
Hussey

(10) Patent No.: US 8,801,338 B2
(45) Date of Patent: Aug. 12, 2014

(54) NESTED MINE ROOF SUPPORTS

(71) Applicant: Micon, Glassport, PA (US)

(72) Inventor: David A. Hussey, Glenwood Springs, CO (US)

(73) Assignee: Micon, Glassport, PA (US)

( * ) Notice: Subject to any disclaimer, the term of this patent is extended or adjusted under 35 U.S.C. 154(b) by 0 days.

(21) Appl. No.: 13/684,773

(22) Filed: Nov. 26, 2012

(65) Prior Publication Data

US 2013/0136545 A1 May 30, 2013

Related U.S. Application Data

(60) Provisional application No. 61/563,976, filed on Nov. 28, 2011.

(51) Int. Cl.
*E21D 15/14* (2006.01)
*E21D 15/502* (2006.01)
*E21D 15/48* (2006.01)

(52) U.S. Cl.
CPC ..... *E21D 15/502* (2013.01); *E21D 15/48* (2013.01)
USPC ..... 405/289; 405/288

(58) Field of Classification Search
CPC ..... E21D 15/14; E21D 15/28; E21D 15/303; E21D 15/42; E21D 15/502; E21D 15/00
USPC ..... 405/272, 288, 289, 290, 294
See application file for complete search history.

(56) References Cited

U.S. PATENT DOCUMENTS

| | | | | | |
|---|---|---|---|---|---|
| 3,564,804 | A * | 2/1971 | Archer et al. | 52/745.17 |
| 4,167,361 | A * | 9/1979 | Petro et al. | 405/290 |
| 4,255,071 | A * | 3/1981 | Koppers et al. | 405/290 |
| 4,277,204 | A * | 7/1981 | Koppers et al. | 405/288 |
| 4,332,512 | A * | 6/1982 | Heintzmann et al. | 405/290 |
| 4,983,077 | A * | 1/1991 | Sorge et al. | 405/288 |
| 5,165,824 | A * | 11/1992 | Corcoran et al. | 405/288 |
| 5,308,196 | A | 5/1994 | Frederick | |
| 5,921,718 | A * | 7/1999 | Kolk | 405/290 |
| 6,394,707 | B1 * | 5/2002 | Kennedy et al. | 405/288 |
| 7,232,103 | B2 * | 6/2007 | Heath | 248/631 |
| 2006/0133899 | A1 * | 6/2006 | Seegmiller | 405/290 |
| 2010/0284752 | A1 * | 11/2010 | Skarbovig | 405/288 |
| 2011/0114813 | A1 * | 5/2011 | Spearing et al. | 248/354.1 |
| 2011/0222970 | A1 * | 9/2011 | Skarbovig | 405/289 |

* cited by examiner

*Primary Examiner* — Benjamin Fiorello
(74) *Attorney, Agent, or Firm* — McNees Wallace & Nurick LLC

(57) ABSTRACT

This invention is directed to a mine roof support set including a plurality of nested containers. Each container in the set has a progressively smaller cross-sectional dimension to allow the containers to be nested one within the other. The plurality of containers can be nested during transportation of the mine roof support set to a mine site. The containers can be separated at the mine site and filled with a load-bearing material. The containers filled with the load-bearing material are placed with their longitudinal axis between a mine roof and a mine floor.

20 Claims, 4 Drawing Sheets

NESTED MINE ROOF SUPPORTS

BACKGROUND OF THE INVENTION

1. Field of the Invention

The present invention relates generally to mine roof supports and, more particularly, to a set of mine roof supports designed to be nested.

2. Description of Related Art

Various roof support devices in the prior art have been designed and used to provide support to a mine roof. Deep mining results in removal of material from the interior of a mine, thereby leaving unsupported voids of various sizes within the mine. These unsupported voids are conducive to mine roof buckling and/or collapse. Thus, it has been desirable to provide support to mine roofs to prevent, delay, or control collapse thereof.

U.S. Pat. No. 5,308,196 to Frederick, herein incorporated by reference, discloses one commonly used prior art mine roof support. Specifically, the Frederick patent discloses a container that is placed between the mine roof and the mine floor and filled with a load-bearing material.

It is not economical to transport such containers for a mine roof support from the manufacturing site to the mine because of their overall size, which can be up to 15 feet in length and 72 inches in diameter, and weight. Because the containers are hollow, their weight is small relative to their volume. Therefore, the number of these containers which may be placed on a truck or railcar for transportation is limited by the volume of space that they occupy and not by their weight. Transportation costs are usually computed based on the distance that a load travels and not how efficiently it uses the available capacity of the transportation vehicle. Thus, the inefficient utilization of the available transportation capacity due to the combination of the high volume and low weight of the containers for the mine roof support results in high transportation costs relative to a load which more efficiently utilizes the capacity of the transportation vehicle.

SUMMARY OF THE INVENTION

Accordingly, the present invention is directed to a set of mine roof supports comprising a plurality of containers adapted to be placed between the mine roof and the mine floor and filled with a load-bearing material, wherein each container has a progressively smaller cross-sectional dimension such that the containers may be nested one within the other. The difference between the cross-sectional dimension of one container and the cross-sectional dimension of the next smaller container, and, thus, the space between the inside surface of the container and the outside surface of the container having the next smaller cross-sectional dimension may be minimized as long as the container having the smaller cross-sectional dimension may be inserted into and extracted from the container having the next larger cross-sectional dimension without binding or becoming stuck.

A method of supporting a mine roof is also disclosed in the present invention. A plurality of containers is associated with a container with a smaller cross-sectional dimension nested within another container with a larger cross-sectional dimension. The plurality of containers is transported via a transportation vehicle to a mine site. Once at the mine site, the containers are separated and filled with a load-bearing material. After the containers have been filled, each container's longitudinal axis is positioned between the mine roof and the mine floor.

DESCRIPTION OF THE PREFERRED EMBODIMENT

The present invention includes a mine roof support set comprising a plurality of containers having a longitudinal axis and adapted to be placed in a void in a mine, with the longitudinal axis extending between the mine roof and the mine floor, and filled with a load-bearing material.

Figure 1:
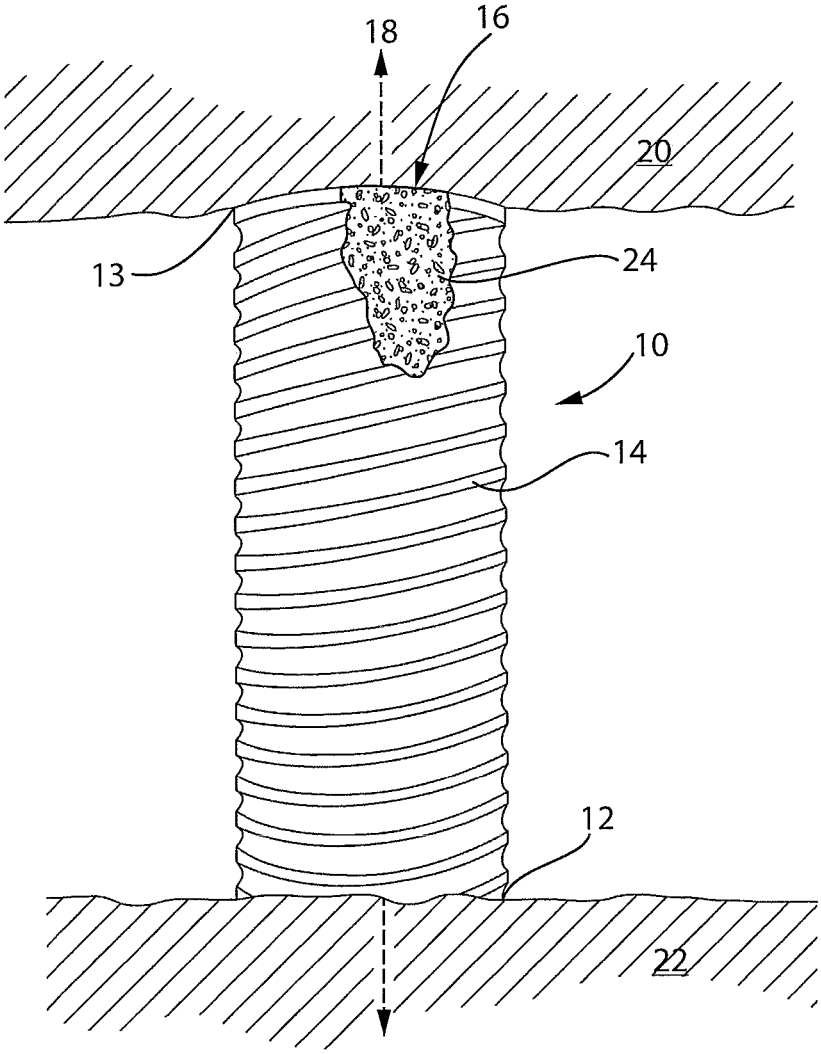
FIG. 1 is a perspective view of one embodiment of a container used in the mine roof support set according to the present invention.

FIG. 1 shows one embodiment of such a container 10. The container has a bottom end 12, a top end 13, and a sidewall 14 extending from the bottom end 12 to the top end 13. The bottom end 12 and/or the top end 13 may be substantially open or may be covered by an end cap (not shown). The sidewall 14 defines a cavity 16.

In use, the container is placed with its longitudinal axis 18 extending between a mine roof 20 and a mine floor 22 such that the bottom end 12 of the container 10 is in contact with the mine floor 22. The cavity 16 is then filled with a load-bearing material 24. In one embodiment of the invention, the load-bearing material 24 is particulate and flowable which provides efficient filling of the cavity 16. By using particulate and flowable materials, a maximum amount of space is filled in the cavity 16, unlike if larger rocks or objects were to be used. Exemplary and non-limiting load-bearing materials 24 include pea gravel, coal from a mine entry, mine slack (i.e., wash plant refuse), foamed cement (FOAMCRETE), concrete, polyurethane, and crushed mine tailings (e.g., discarded excavated mine material). Footing material (not shown), such as wood timber or other material, may be placed between either or both ends 12, 13 of the container 10 and the respective mine roof 20 and/or floor 22 to account for differences between the height of the container 10 and the height of the void in the mine. Alternatively, a cap or a base (not shown) having a thickness may be used in the manner of a shim to assure that the container 10 contacts both the roof and the floor of the mine. The cap or base may be a rubber ring or of any other suitable shape and/or material that effectively fills a gap between the mine roof 20 or floor 22 and the ends 12, 13 of the container 10. Other shims may include pumpable containment structures (e.g., bags) or a pumpable telescoping structure such as disclosed in U.S. Pat. No. 6,394,707, incorporated herein by reference.

Although the container 10 shown in FIG. 1 is cylindrical, the container of the present invention may have any cross-sectional shape including, but not limited to, circular, oval, square, rectangular, and polygonal. It may be made from any suitable material including, but not limited to, metal. It may include features to allow it to be compressible or improve its load-bearing capability when placed in the mine void or improve its stiffness when being transported including, but not limited to, ribbing. The ribbing of the container 10 may include, but is not limited to, a continuous helical rib, a plurality of discontinuous ribs or a plurality of spaced apart ribs. Alternatively, as shown in FIGS. 2-5, the container sidewall 14 may instead have a substantially smooth surface. By substantially smooth surface, it is meant that the sidewall does not include any ribs, corrugation, or the like, although certain dents and other imperfections may be present which do not affect operation of the present invention.

Figure 2:
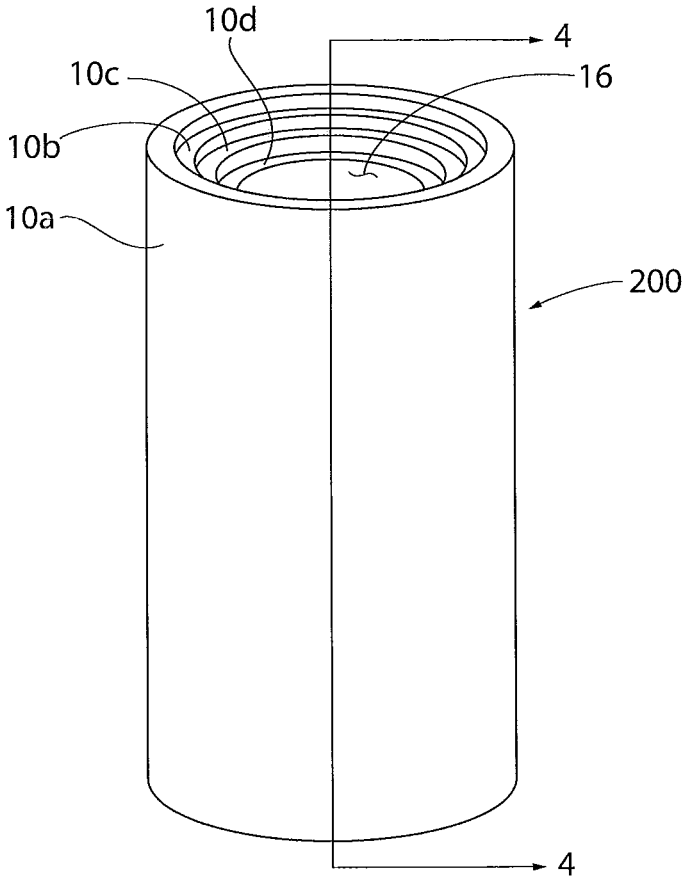
FIG. 2 is a perspective view of one embodiment of a mine roof support set according to the present invention showing the mine roof support set in the nested condition.
Figure 3:
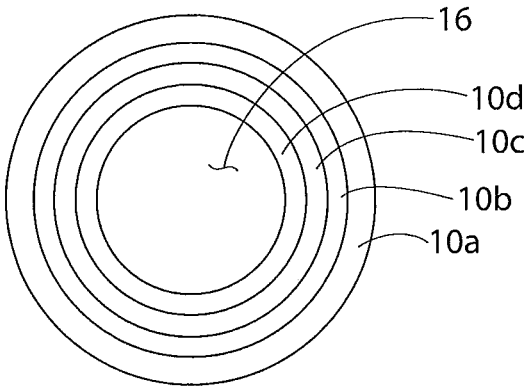
FIG. 3 is a plan view of the mine roof support set shown in FIG. 2.
Figure 4:
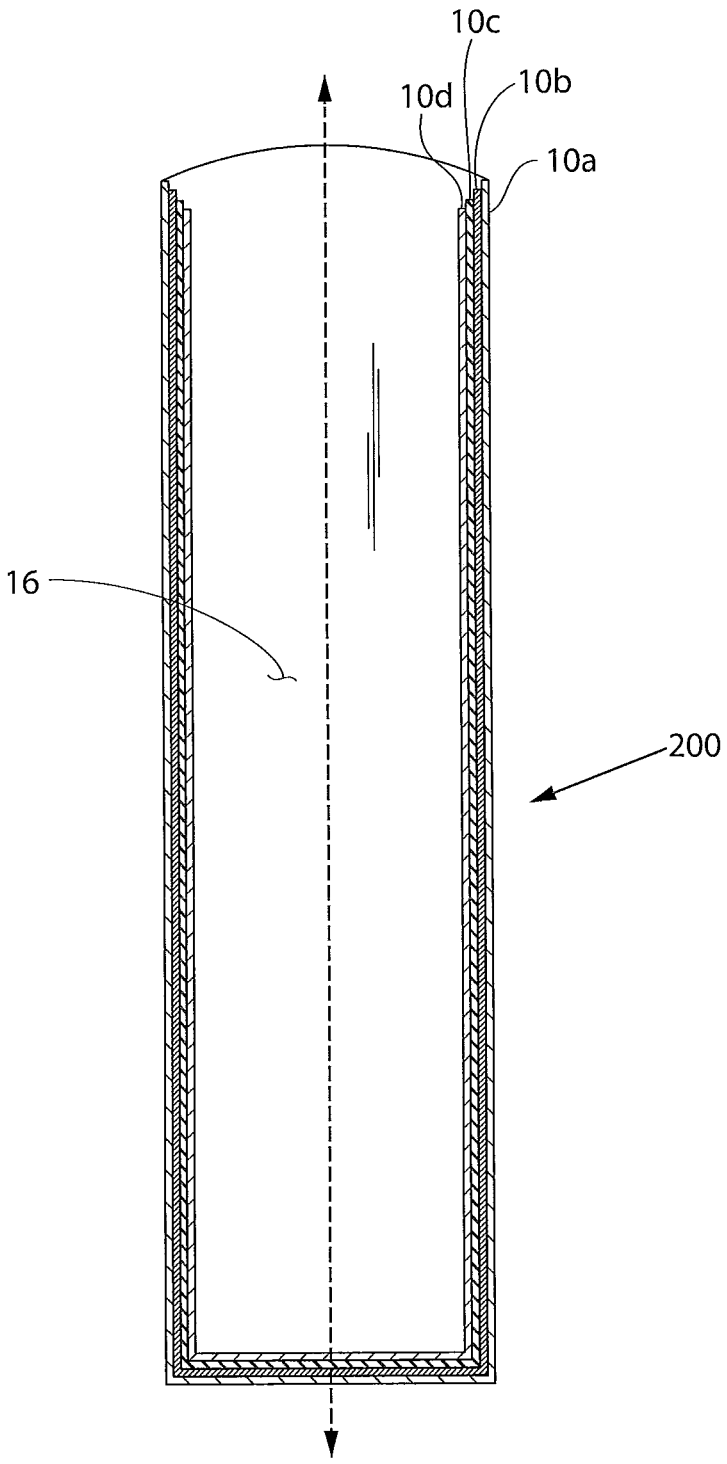
FIG. 4 is a cross-sectional view of one embodiment of the mine roof support set shown in FIG. 2 taken along line 4-4.

FIG. 2 shows a perspective view of one embodiment of a mine roof support set 200 according to the present invention. As can be seen in FIG. 2, containers 10*a*-10*d* are nested one within another for ease of handling, such as in transportation to a mine site. The outside dimension (for the cylinders of set 200, 10*a* being the outside diameter) of each container is progressively smaller than the next. As shown in FIGS. 2-4, container 10*a* has the largest outside diameter, with containers 10*b*, 10*c* and 10*d* having progressively smaller outside diameters. Four containers 10 are shown in FIGS. 2-4, but this is not meant to be limiting. The quantity of containers 10 nested in a set 200 may be varied depending on the underground conditions and related logistics, including the roof control plan.

In one embodiment, the containers 10 all possess the same or similar sidewall 14 thickness. The outer dimension of each subsequently smaller container 10 is determined at least in part by the inside diameter of the larger container 10 into which it is received, as well as the sidewall thickness. The difference in the cross-sectional dimension between each container 10 and the next smaller container 10 and, thus, the gap between the inner surface of the container 10 and outer surface of the next smaller container 10 is minimized. The cross-sectional dimension of the container 10 is one factor that determines the load-bearing capability of the mine support. Therefore, when it is desired that all of the mine supports in the set have load-bearing capability within a specific engineering tolerance, the difference in cross-sectional dimension between each container 10 and the next smaller container 10 may be minimized to allow the maximum number of containers 10 having a cross-sectional dimension providing load-bearing capability within the engineering tolerance to be nested. To accomplish this, the cross-sectional dimension of each successively smaller container 10 is reduced by the minimum amount necessary to allow it to be inserted into and removed from the container 10 having the next larger cross-sectional dimension, without binding or getting stuck. In one embodiment, a first container 10 is sized to be received within a second container 10 as a frictional fit. By frictional fit, it is meant that the respective surfaces of the first and second containers 10 may abut each other during insertion into or removal of the first container into the second container yet without binding therebetween or otherwise becoming stuck. To the extent that one or more of the smaller diameter containers 10 of the set 200 provides reduced load-bearing capabilities compared to other containers in the set, the roof support plan incorporating such containers may be adjusted as necessary. For example, the smaller diameter containers 10 may be spaced slightly closer together or closer to other such containers than larger diameter containers 10. The differences in the cross-sectional dimension between one container 10 and the next smaller container 10 may be of any magnitude and may be uniform or vary throughout the set. The lengths of the containers 10 may also be constant or vary from container to container. The containers may have the same cross-sectional shape or the shape of the cross-section may vary from container to container as long as the containers may still be nested one inside the other. In general, when nested, the cavity 16 of each container 10 is empty. In one embodiment, the cavity 16 is filled with the load-bearing material once the containers are separated at a mine site.

Referring to FIGS. 3 and 4, the mine roof support set 200 includes the plurality of containers 10 nested one within another, with each container 10 having a progressively smaller cross-sectional dimension than the container 10 in which it is nested. While no gap is shown between the inside of one container (e.g., 10*a*) and the outside of a progressively smaller container (e.g., 10*b*), there is at least some gap therebetween so that container 10*b* may be fitted into container 10*a* and then removed therefrom without becoming stuck. In FIGS. 2 and 4, the containers 10*a*-10*d* are shown as having progressively reduced heights, such that container 10*a* receives all of containers 10*b*-10*d* and container 10*b* receives all of containers 10*c* and 10*d*. This is not meant to be limiting. For example, the containers 10 may all have the same height or the containers 10 may have decreasing outer dimensions taken in the direction from the outermost container 10 to the innermost container 10 or some other arrangement, including random heights, provided that the containers 10 nest in each other.

Figure 5:
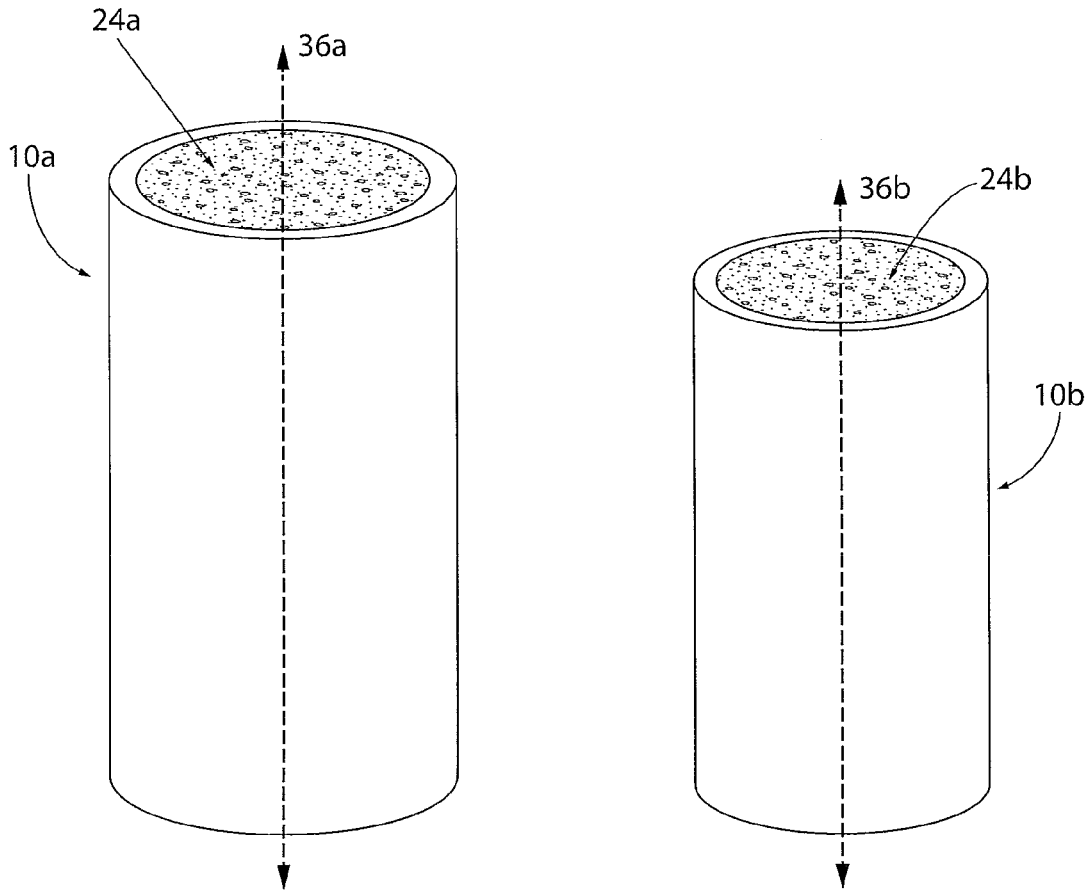
FIG. 5 is a perspective view of one embodiment of two un-nested containers filled with a load-bearing material according to the present invention.

FIG. 5 shows perspective views of one embodiment of containers 10*a*, 10*b* separated from each other and filled with load-bearing material 24*a*, 24*b*. Two containers are shown and described here (10*a*, 10*b*) for simplicity. However, it is contemplated that each nested set 200 could include up to ten containers 10. The mine roof support set 200 according to the present invention includes nested containers 10 for transportation. This allows for more efficient use of the capacity of a transportation vehicle. By nesting the containers 10 inside of each other, more space on a transportation vehicle is available than if each individual container 10 were to be transported separately. By providing additional space on the transportation vehicle the user is able to transport more items to the mine site with fewer trips and at a lower cost. After the nested container set 200 has been unloaded at the mine site, the container set 200 is transported into the mine and the containers (e.g., 10*a*, 10*b*) are separated from one another. Each container 10*a*, 10*b* is then filled with load-bearing material 24*a*, 24*b*, which may be the same or different material from each other. The load-bearing material 24*a*, 24*b* may be flowable, thereby providing an efficient manner in which to fill the containers 10. By using particulate and flowable material, the user can deliver the material 24*a*, 24*b* into the top of each container 10*a*, 10*b* with minimal effort. After the containers 10*a*, 10*b* have been filled, each container 10*a*, 10*b* is positioned with its longitudinal axis 36*a*, 36*b* between the mine roof and the mine floor. The containers 10 may be shimmed above and below ends 12 and 13 as needed to fit within the mine opening.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this specification.

The invention claimed is:

1. A mine roof support set comprising a plurality of containers, each said container comprising a closed bottom end, an open top end, and a sidewall that defines a cross-sectional dimension and having a longitudinal axis, each said container being adapted to be placed with the longitudinal axis extending between a mine roof and a mine floor oriented such that the top end of each container is distal from the mine floor and the bottom end of each container is distal from the mine roof, wherein each container in the set has a progressively smaller cross-sectional dimension to allow the containers to be nested one within the other such that the closed bottom end of each nested container is enveloped by the open top end of another container.

2. The mine roof support set according to claim 1, wherein a difference between the cross-sectional dimension of a first container and the cross-sectional dimension of a second container is sized to permit the first container to be inserted into and removed from the second container with a frictional fit.

3. The mine roof support system according to claim 1, wherein the container sidewall comprises a substantially smooth surface.

4. The mine roof support system according to claim 1, wherein the container sidewall comprises ribs.

5. The mine roof support system according to claim 4, wherein the container sidewall comprises a helical rib or spaced apart ribs.

6. A mine roof support system comprising: (i) a plurality of containers, each said container comprising a closed bottom end, an open top end, and a sidewall that defines a cross-sectional dimension and having a longitudinal axis, each container being adapted to be placed with the longitudinal axis extending between a mine roof and a mine floor oriented such that the top end of each container is distal from the mine floor and the bottom end of each container is distal from the mine roof, wherein said containers have a progressively smaller cross-sectional dimension; and (ii) load-bearing material to be received within each said container.

7. The mine roof support system according to claim 6, wherein the cross-sectional dimensions of the containers are sized such that the containers are nestable one within another prior to filling the containers with the load-bearing material.

8. The mine roof support system according to claim 6, wherein the container sidewall comprises a substantially smooth surface.

9. The mine roof support system according to claim 6, wherein the container sidewall comprises ribs.

10. The mine roof support system according to claim 9, wherein the container sidewall comprises helical ribs or spaced apart ribs.

11. The mine roof support system according to claim 6, wherein the load-bearing material is particulate and flowable.

12. The mine roof support system according to claim 11, wherein the load-bearing material comprises pea gravel, coal from a mine entry, mine slack, foamed cement, concrete, polyurethane, and/or crushed mine tailings.

13. A method of supporting a mine roof comprising: (i) assembling a plurality of containers, each said container comprising a closed bottom end, an open top end, and a sidewall that defines a cross-sectional dimension and having a longitudinal axis, each container being adapted to be placed with the longitudinal axis extending between a mine roof and a mine floor oriented such that the top end of each container is distal from the mine floor and the bottom end of each container is distal from the mine roof, wherein said containers have a progressively smaller cross-sectional dimension; (ii) filling said containers with a load-bearing material; and (iii) positioning the longitudinal axis of said filled containers between a mine roof and a mine floor oriented such that the top end of each container is distal from the mine floor and the bottom end of each container is distal from the mine roof.

14. The method of supporting a mine roof according to claim 13, wherein the cross-sectional dimensions of the containers are sized such that the containers are nestable one within another prior to filling the containers with the load-bearing material.

15. The method of supporting a mine roof according to claim 13, wherein the container sidewall comprises a substantially smooth surface.

16. The method of supporting a mine roof according to claim 13, wherein the container sidewall comprises ribs.

17. The method of supporting a mine roof according to claim 16, wherein the container sidewall comprises a helical rib or spaced apart ribs.

18. The method of supporting a mine roof according to claim 13, wherein the containers are filled by flowing the load-bearing material into said containers.

19. The method of supporting a mine roof according to claim 18, wherein the load-bearing material is particulate.

20. The method of supporting a mine roof according to claim 19, wherein the load-bearing material comprises pea gravel, coal from a mine entry, mine slack, foamed cement, concrete, polyurethane, and/or crushed mine tailings.

* * * * *